US009411255B1

(12) United States Patent
Wu et al.

(10) Patent No.: US 9,411,255 B1
(45) Date of Patent: Aug. 9, 2016

(54) ELECTROSTATIC CHARGING MEMBER

(71) Applicant: Xerox Corporation, Norwalk, CT (US)

(72) Inventors: Jin Wu, Pittsford, NY (US); Christopher D. Blair, Webster, NY (US); Amy C. Porter, Pittsford, NY (US); Lin Ma, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/853,503

(22) Filed: Sep. 14, 2015

(51) Int. Cl.
*G03G 15/02* (2006.01)

(52) U.S. Cl.
CPC ..... *G03G 15/0233* (2013.01)

(58) Field of Classification Search
CPC ..... G03G 15/0233; G03G 15/0216
See application file for complete search history.

(56) References Cited

U.S. PATENT DOCUMENTS

| | | | | |
|---|---|---|---|---|
| 8,090,298 | B2 | 1/2012 | Hoshio et al. | |
| 2008/0075505 | A1* | 3/2008 | Nagamori | G03G 15/0233 399/176 |
| 2011/0052252 | A1* | 3/2011 | Lin | G03G 15/0233 399/109 |
| 2012/0213553 | A1* | 8/2012 | Hoshio | G03G 15/0233 399/176 |

* cited by examiner

*Primary Examiner* — Gregory H Curran
(74) *Attorney, Agent, or Firm* — Hoffman Warnick LLC

(57) ABSTRACT

The present teachings described a bias charging member and a method of manufacture. According to an embodiment, there is provided a bias charging member. The bias charging member includes an outer surface layer disposed on the conductive core. The outer surface layer includes ceramic microspheres having an average size of from 1 micron to 40 microns present in an amount of from about 5 to about 40 weight percent of the outer layer.

17 Claims, 1 Drawing Sheet

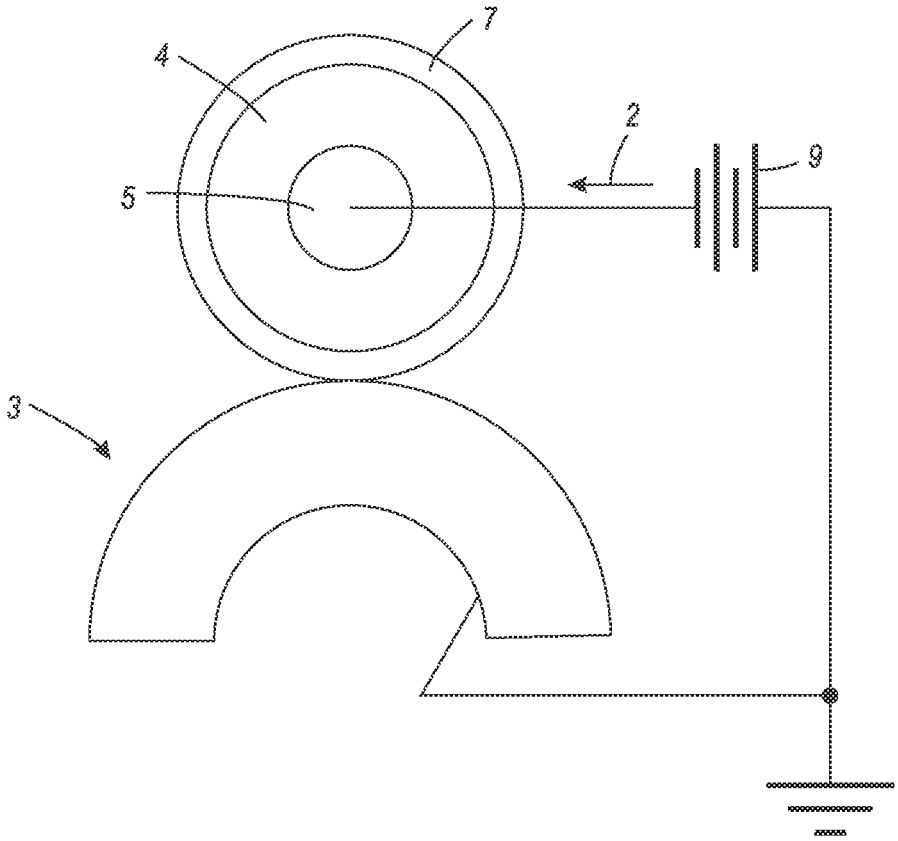
7
4
2
9
5
3

ELECTROSTATIC CHARGING MEMBER

BACKGROUND

1. Field of Use

The present invention relates to an electrostatic charging member, and more specifically, to an outer surface layer of an electrostatic charging member.

2. Background

Image forming apparatuses require electrostatic charging of an image holding member by use of an electrostatic charging member or bias charging member. Electrostatic latent images differing from their surroundings in electric potential are formed on the electrostatically charged image holding member. The electrostatic latent images are developed with a developer containing toner, and eventually transferred to a recording material.

Electrostatic charging members are devices having the function of charging electrostatically image holding members and can use a contact charging method, wherein the charging member is brought into direct contact with the image holding member to perform electrostatically charge of the image holding members.

The electrostatic charging member is equipped with an electrostatic charging member, such as an electrostatic charging roll, which is brought into direct contact with the surface of an image holding member and made to rotate in synchronization with movement of the image holding member's surface, thereby giving electrostatic charges to the image holding member. The electrostatic charging roll is made up of, e.g., a base material and an elastic conducting layer formed around the peripheral surface of the base material and an outer most layer.

Typically, porous polyimide fillers have been used in the outer layer of an electrostatic charging roll. However, there are drawbacks to using porous polyamide fillers. These problems include swelling in organic solvents and the low melting point (about 170-180° C.) of polyimide.

It would be desirable to have a filler for an outer layer of a bias charging roller that provides robust morphology control, does not swell in organic solvents and has a melting point greater than 180° C.

SUMMARY

According to an embodiment, there is provided a bias charging member including a conductive core, and an outer surface layer disposed on the conductive core. The outer surface layer includes ceramic microspheres having an average size of from 1 micron to 40 microns present in an amount of from about 5 to about 40 weight percent of the outer layer.

According to another embodiment, there is provided a method of manufacturing a bias charging member including mixing a polyamide resin, ceramic microspheres, an acid catalyst and carbon black to obtain a dispersion. The dispersion is coated on a bias charging roll substrate. The coating is heated to form an outer layer.

According to another embodiment, there is provided a bias charging member including a conductive core, a base material disposed on the conductive core and an outer surface layer disposed on the base material. The outer surface layer includes a binder, ceramic microspheres, an acid catalyst and carbon black.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

FIG. 1 demonstrates an illustrative bias charging roll (BCR) having an electrically conductive core and an outer surface layer provided thereon.

It should be noted that some details of the FIGS. have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely illustrative.

Illustrations with respect to one or more implementations, alterations and/or modifications can be made to the illustrated examples without departing from the spirit and scope of the appended claims. In addition, while a particular feature may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Referring to FIG. 1, there is shown an embodiment having a bias charging roller (BCR) 2 held in contact with an image carrier implemented as a photoconductive member 3. However, embodiments herein can be used for charging a dielectric receiver or other suitable member to be charged. The photoconductive member 3 may be a drum, a belt, a film, a drelt (a cross between a belt and a drum) or other known photoconductive member. While the BCR 2 is in rotation, a DC voltage and optional AC current is applied from a power source 9 to an electro-conductive core 4 of the BCR 2 to cause it to charge the photosensitive member 3. Shown in FIG. 1, the electro-conductive core 4 is surrounded by a base material 5. Although shown as one layer, it is possible to eliminate the base material 5 or have multiple layers of base material 5. These layers are referred to as base layers, intermediate layers or substrate layers. The base material 5 for the BCR 2 can be any elastic material with conductive dopant of suitable fillers discussed below. A partially conductive protective overcoat is provided on the base material 5 of the BCR 2 to form the outer surface layer 7. There may or may not be a filler in the substrate layer, intermediate layer, and outer layer.

The electro-conductive core 4 serves as an electrode and a supporting member of the charging roll, and is composed of an electro-conductive material such as a metal or alloy of aluminum, copper alloy, stainless steel or the like; iron coated with chromium or nickel plating; an electro-conductive resin and the like. The diameter of the electro-conductive core is, for example, about 1 mm to about 20 cm, or from about 5 mm to about 2 cm.

The base material 5 can be isoprene rubber, chloroprene rubber, epichlorohydrin rubber, butyl rubber, polyurethane, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer copolymer rubber (EPDM), acrylonitrile-butadiene copolymer rubber (NBR), natural rubber, and blends thereof. Among these, polyurethane, silicone rubber, EPDM, epichlorohydrin-ethylene oxide copolymer rubber, epichlorohydrin-ethylene oxide-allyl glycidyl ether copolymer rubber, NBR, and blends thereof are preferably used.

An electro-conductive agent, an electronic electro-conductive agent or an ionic electro-conductive agent may be used in the base materials. Examples of the electronic electro-conductive agent include fine powder of: carbon black such as Ketjen Black and acetylene black; pyrolytic carbon, graphite; various kinds of electro-conductive metal or metal alloy such as aluminum, copper, nickel and stainless steel; various kinds of electro-conductive metal oxide such as tin oxide, indium oxide, titanium oxide, tin oxide-antimony oxide solid solution, and tin oxide-indium oxide solid solution; insulating materials having a surface treated by an electro-conductive process; and the like. Furthermore, examples of the ionic electro-conductive agent include perchlorates or chlorates of tetraethylammonium, lauryltrimethyl ammonium and the like; perchlorates or chlorates of alkali metal such as lithium and magnesium, and alkali earth metal; and the like. These electro-conductive agents may be used alone, or in combination of two or more kinds thereof.

Furthermore, the amount of addition to the base materials is not particularly limited. For example, the amount of electro-conductive agent to be added is from about 1 to about 30 parts by weight, or from about 5 to about 25 parts by weight with respect to 100 parts by weight of the rubber material. The amount of the ionic electro-conductive agent to be added is in the range of about 0.1 to about 5.0 parts by weight, or from about 0.5 to about 3.0 parts by weight with respect to 100 parts by weight of the rubber material. The layer thickness of the base material is from about 1 mm to about 20 cm, or from about 5 mm to about 3 cm.

The outer layer or protective overcoat layer 7 contains ceramic microspheres dispersed in a polymer. The ceramic is a material such as alkali aluminosilicate and soda lime borosilicate. The ceramic microspheres are present in the outer layer at from 5 weight percent to about 40 weight percent based on the total weight of the outer layer. The outer layer thickness is from about 0.1 μm to about 500 μm, or from about 1 μm to about 50 μm. The outer layer can include any suitable binder material or resin such as fluorine resins, polyamide resins, acrylic resins, polyurethane resins, silicone resins, butyral resins, styrene copolymers and olefinic copolymers. In embodiments, elastomers can be used for the surface layer binder, including natural rubbers, synthetic rubbers and thermoplastic elastomers.

In an embodiment, the polymer resin of the outer layer 7 is a polyamide resin. The percentage of a polyamide resin is preferably from about 50 weight percent to about 99 weight percent, or in embodiments from about 60 weight percent to 99 weight percent, or from about 65 weight percent to 95 weight percent.

Solvent-soluble polyamide resins, notably polyamide resins soluble in alcohol such as methanol or ethanol, are suitable for allowing easy formation of the outer layer of a bias charging roller by a coating film-forming method such as dip coating.

Examples of a solvent-soluble polyamide resin include alcohol-soluble polyamide resins, such as N-alkoxyalkylated nylons produced by alkoxyalkylation of nylons including nylon homopolymers, such as nylon 6, nylon 11, nylon 12, nylon 6,6 and nylon 6,10, and nylon copolymers each of which is constituted of at least two among the nylons recited above.

Of the alcohol-soluble polyamide resins, N-alkoxymethylated nylons, notably N-methoxymethylated nylons, are preferable to the others from the viewpoint of achieving higher level of excellence in long-term retention of electrostatic charging capability.

In particular, nylon 6 is methoxymethylated with the scheme below:

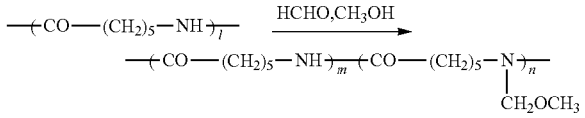

Commercial N-methoxymethylated nylon 6 examples include FINE RESIN® FR101 (about 30% methoxymethylation rate, weight average molecular weight of about 20,000, obtained from Namariichi Co., Ltd.), TORESIN® F30K (weight average molecular weight of about 25,000, obtained from Nagase ChemTex Corp.), and TORESIN® EF30T (weight average molecular weight of about 60,000, obtained from Nagase ChemTex Corp.).

In embodiments, the conductive component can include carbon black, a metal oxide, or a conductive polymer. Examples of the conductive component include fine powder of: carbon black such as Ketjen Black and acetylene black; pyrolytic carbon, graphite; various kinds of electro-conductive metal or metal alloy such as aluminum, copper, nickel and stainless steel; various kinds of electro-conductive metal oxide such as tin oxide, indium oxide, titanium oxide, tin oxide-antimony oxide solid solution, and tin oxide-indium oxide solid solution; insulating materials having a surface treated by an electro-conductive process; and the like. Furthermore, examples of conductive polymers include polythiophene, polyaniline, polypyrrole, polyacetylene and the like. These electro-conductive agents may be used alone, or in combination of two or more kinds thereof. The amount of conductive component in the outer surface is from 0.1 to about 60 weight percent based on the weight of total solids in the outer surface layer. The carbon black conductive components that can be incorporated into the outermost layer include MONARCH® 1000, EMPEROR® E1200, 1600, all obtained from Cabot Corp.

In embodiments the ceramic microspheres have an average size or diameter of from 1 micron to 50 microns, or in embodiments from 1 micron to 30 microns or from 2 microns to 15 microns. The ceramic microspheres are from a material such as alkali aluminosilicate or soda lime borosilicate.

Compared with the polyamide fillers disclosed in U.S. Pat. No. 8,090,298, the ceramic microspheres of alkali aluminosilicate possess the following advantages summarized in Table 1:

TABLE 1

| Fillers | 3M ™ W-210 | 3M ™ W-410 | ORGASOL ® 2001UDNAT1 | ORGASOL ® 2001EXDNAT1 |
|---|---|---|---|---|
| Material Type | alkali alumino silicates | alkali alumino silicates | porous polyamides | porous polyamides |
| Thermal conductivity (W/mK) | 2.3 | 2.3 | 0.1-0.2 | 0.1-0.2 |
| Surface area ($m^2/g$) | 5 | 3 | 9 | 4 |
| Melting point (° C.) | 1,020 | 1,020 | 177 | 177 |
| Other properties | no swelling in solvents | no swelling in solvents | swelling in solvents | swelling in solvents |

3M™W-210 and 3M™W-410 are ceramic microspheres available from 3M; and ORGASOL® is porous polyamide filler available from Arkema.

Examples of an acid catalyst suitable for the outer layer include aliphatic carboxylic acids, such as acetic acid, chloroacetic acid, trichloroacetic acid, trifluoroacetic acid, oxalic acid, maleic acid, malonic acid, lactic acid and citric acid; aromatic carboxylic acids, such as benzoic acid, phthalic acid, terephthalic acid and trimellitic acid; aliphatic and aromatic sulfonic acids, such as methanesulfonic acid, dodecylsulfonic acid, benzenesulfonic acid, dodecylbenzenesulfonic acid, naphthalenesulfonic acid, p-toluenesulfonic acid, dinonylnaphthalenesulfonic acid (DNNSA), dinonylnaphthalenedisulfonic acid (DNNDSA) and phenolsulfonic acid; and phosphoric acid.

The bulk and surface conductivity of the outer surface layer 7 should be higher than that of the BCR 2 to prevent electrical drain on the BCR 2, but only slightly more conductive. Surface layers 7 with from about $1\times10^2$ ohm/to about $1\times10^{12}$ ohm/, of from about $1\times10^4$ ohm/to about $1\times10^8$ ohm/, or from about $1\times10^5$ ohm/to about $1\times10^7$ ohm/surface resistivity were found to be suitable.

The surface roughness ($R_z$) of the outermost layer is in a range of about 1 micron to about 20 microns, or in embodiments in a range of about 4 microns to about 18 microns or in a range of about 3 microns to about 15 microns. By controlling the surface roughness $R_z$ of the outermost layer to the 1 micron to 20 micron range, the durability of the electrostatic charging member is improved, and outstanding long-term retention of electrostatic charging capability is achieved.

The outer layer is coated onto the elastic conducting layer from an alcohol based dispersion including, the polyamide resin and the ceramic microspheres, and thermally cured (at about 100° C. to 180° C.). The ceramic microspheres are incorporated to modify overcoat surface morphology for reduced BCR contamination.

A dispersion of a polyamide resin is prepared by ball milling the polyamide resin in a solvent with the conductive material. A catalyst is added to the dispersion to lower the curing temperature and is optional. Ceramic microspheres are added to control the outer surface roughness. The dispersion is then coated on the BCR 2. The coating is cured at a temperature of about 25 to about 200° C., or from about 100 to about 180° C., for about 10 to about 120 minutes, or from about 25 to 65 minutes. Typical coating techniques include dip coating, roll coating, spray coating, rotary atomizers, ring coating, die casting, flow coating and the like.

Examples

Experimentally, ceramic microspheres were compared to porous polyamide fillers in the outer layer of a bias charging roller.

Experimentally, the outer layer dispersion was prepared by mixing FINE RESIN® FR101 (an N-methoxymethylated nylon 6 resin from Namariichi Co., Ltd.) and p-toluenesulfonic acid with a weight ratio of 100/3 in methanol/1-butanol/water=75/20/5 (about 10 weight percent solid) via agitation to obtain a polymeric base solution.

An outer layer dispersion (comparative) using polyamide filler was preparing by adding 20 weight percent carbon black (MONARCH® 1000 available from CABOT) and 30 weight percent of ORGASOL® 2001UDNAT1 (a polyamide particle from Arkema) to the polymeric base solution. An outer layer dispersion using ceramic microspheres was prepared by adding 25 weight percent carbon black (MONARCH® 1000 available from CABOT) and 30 weight percent of alkali aluminosilicate microspheres (3M™ W-210 available from 3M) to the polymeric base solution. Both dispersions were mixed in a ball mill with 2 mm stainless steel shots for 20 hours using a paint shaker.

Both dispersions were filtered through a paint filter to obtain the final outer layer coating dispersions. The comparative Example included polyamide resin/carbon black/polyamide filler/p-toluenesulfonic acid catalyst in weight ratio of 65.4/13.1/19.6/1.9 in methanol/1-butanol/water=75/20/5. The Example containing the ceramic microspheres included polyamide resin/carbon black/ceramic microspheres/p-toluenesulfonic acid catalyst in weight ratio of 63.3/15.8/19.0/1.9 in methanol/1-butanol/water=75/20/5. Both dispersions were at about 15 weight percent solids.

Each dispersion was coated on a bias charging roller using a Tsukiage coater. Each coated dispersion was cured at 160° C. for 30 minutes to obtain a 10-micron thick outer layer. The BCR outer layer was tested for physical properties including surface resistivity and surface roughness $R_z$ as shown in Table 2. The surface morphology was monitored using optical microscope to identify roughness uniformity and any cracks in the outermost layer.

TABLE 2

| | Surface resistivity (ohm/sq) | $R_z$ (micron) |
|---|---|---|
| The outermost layer including amorphous polyamide filler | ~$1.00\times10^7$ | 6.50 |
| The outermost layer including ceramic microsphere | ~$1.45\times10^7$ | 4.76 |

The BCR outermost layer including ceramic microspheres of alkali aluminosilicate was tested for key physical properties including surface resistivity and surface roughness $R_z$ (Table 2), and the surface morphology was monitored using light microscope to identify roughness uniformity and any cracks in the outermost layer. The results were compared with those from the outermost layer including the porous polyamide filler.

The outermost layer including ceramic microsphere had significantly less cracks than the control outermost layer having porous polyamide filler. Fewer cracks result in longer BCR life and increased contamination resistance.

It will be appreciated that variants of the above-disclosed and other features and functions or alternatives thereof may be combined into other different systems or applications. Various presently unforeseen or unanticipated alternatives, modifications, variations, or improvements therein may be subsequently made by those skilled in the art, which are also encompassed by the following claims.

What is claimed is:

1. A bias charging member comprising:

a) a conductive core, and b) an outer surface layer disposed on the conductive core, the outer surface layer comprising:

ceramic microspheres having an average size of from 1 micron to 40 microns present in an amount of from about 5 to about 40 weight percent of the outer layer, wherein the ceramic microspheres comprise a material selected from a group consisting of alkali aluminosilicate and soda lime borosilicate.

2. The bias charging member in accordance with claim 1, wherein the outer surface layer further comprises a binder, a conductive component and a catalyst.

3. The bias charging member in accordance with claim 2, wherein the conductive component is selected from the group consisting of: carbon black, metal oxides, and conductive polymers.

4. The bias charging member in accordance with claim 2, wherein the catalyst is an acid selected from the group consisting of: aliphatic carboxylic acids and aromatic carboxylic acids and aromatic sulfonic acids.

5. The bias charging member in accordance with claim 2, wherein the binder comprises N-alkoxyalkylated polyamide.

6. The bias charging member in accordance with claim 2, wherein the conductive component comprises from about 0.1 to about 60 percent by weight based on the weight of total solids of the outer surface layer.

7. The bias charging member in accordance with claim 1, further comprising a base material disposed between the conductive core and the outer surface layer.

8. The bias charging member in accordance with claim 7, wherein the base material is selected from the group consisting of: isoprene rubber, chloroprene rubber, epichlorohydrin rubber, butyl rubber, polyurethane, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer copolymer rubber, acrylonitrile-butadiene copolymer rubber (NBR) and natural rubber.

9. A method of manufacturing a bias charging member comprising:

mixing a polyamide resin, ceramic microspheres, wherein the ceramic microspheres comprise a material selected from a group consisting of alkali aluminosilicate and soda lime borosilicate, an acid catalyst and carbon black to obtain a dispersion;

coating the dispersion on a bias charging roll substrate; and heating the coating to form an outer layer.

10. The method of claim 9, wherein the carbon black comprises an amount from about 1 to about 30 percent by weight based on the weight of total solids of the outer layer.

11. The method of claim 9, wherein the bias charging roll substrate comprises a base material disposed over a conductive core.

12. The method of claim 11, wherein the base material is selected from the group consisting of: isoprene rubber, chloroprene rubber, epichlorohydrin rubber, butyl rubber, polyurethane, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer copolymer rubber, acrylonitrile-butadiene copolymer rubber (NBR) and natural rubber.

13. The method of claim 9, wherein the heating is at a temperature of from about 100° C. to about 200° C. for a time of from about 10 minutes to about 180 minutes.

14. A bias charging member comprising:

a) a conductive core, b) a base material disposed on the conductive core; and c) an outer surface layer disposed on the base material comprising a binder, ceramic microspheres, wherein the ceramic microspheres comprise a material selected from a group consisting of alkali aluminosilicate and soda lime borosilicate, an acid catalyst and carbon black.

15. The bias charging member of claim 14, wherein the base material is selected from the group consisting of: isoprene rubber, chloroprene rubber, epichlorohydrin rubber, butyl rubber, polyurethane, silicone rubber, fluorine rubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene terpolymer copolymer rubber, acrylonitrile-butadiene copolymer rubber (NBR) and natural rubber.

16. The bias charging member in accordance with claim 14, wherein the acid catalyst is an acid selected from the group consisting of: aliphatic carboxylic acids and aromatic carboxylic acids and aromatic sulfonic acids.

17. The bias charging member in accordance with claim 14, wherein the ceramic microspheres comprise an amount of from about 5 to about 40 weight percent of the outer surface layer.

* * * * *